US005810466A

United States Patent [19]

Young

[11] Patent Number: 5,810,466

[45] Date of Patent: Sep. 22, 1998

[54] WALKING CANE

[76] Inventor: Michael D. Young, 1941 N. Sheffield, Chicago, Ill. 60614

[21] Appl. No.: 784,689

[22] Filed: Jan. 15, 1997

[51] Int. Cl.[6] ..... A45B 3/04

[52] U.S. Cl. ..... 362/102; 362/234; 135/66; 135/910

[58] Field of Search ..... 362/102, 109, 362/208, 231, 234; 135/65, 66, 910

[56] References Cited

U.S. PATENT DOCUMENTS 5,331,990 7/1994 Hall et al. ..... 362/102

FOREIGN PATENT DOCUMENTS 114929 8/1984 European Pat. Off. ..... 135/910

2666968 3/1992 France ..... 135/66

2184651 7/1987 United Kingdom ..... 135/65

*Primary Examiner*—Stephen F. Husar

*Attorney, Agent, or Firm*—Mason, Kolehmainen, Rathburn & Wyss

[57] ABSTRACT

A walking cane includes an elongated leg with a foot at a lower end and a transversely extending handle at an upper end for manipulating the cane and directionally controlling a flashlight in the handle to illuminate a travel path forwardly of the cane. An elongated, gas filled tube light is provided in the leg of the cane between the foot and handle for general illumination around the area. Each light source is selectively controlled and powered by batteries self-contained in the handle body of the walking cane.

16 Claims, 1 Drawing Sheet

WALKING CANE

BACKGROUND OF THE INVENTION

1. Field of the Invention

The present invention relates to a new and improved walking cane and more particularly to a light carrying walking cane for illuminating a walking area ahead of a user carrying the cane and/or illuminating a general area around the cane. The new and improved cane is useful indoors or outdoors and is especially useful in assisting people in getting in and out of bed or chairs in darkened areas or regions of low light level. The new and improved cane enables a user to direct a forward beam or shaft of light to illuminate a walking path, illuminate stairways and furniture in darkened areas and includes a gas filled tube light for illumination of the general area around the cane so that minimal adjustment of the eyes is required so that disturbances to other persons in the area are minimized.

2. Description of the Prior Art

Over the years canes and walkers have been developed to assist the mobility of aged, injured and disabled persons.

OBJECTS OF THE PRESENT INVENTION

It is an object of the present invention to provide a new and improved walking cane and more particularly a lighted walking cane for directing a beam or shaft or light forwardly of the cane to illuminate a walking or movement path for the user and/or providing for general illumination of an area around the cane adapted to minimize the need for additional illumination sources.

It is an object of the present invention to provide a new and improved walking cane having a handle that is movable to directionally control a light beam and a low level light source for illuminating a general area around a leg of the cane.

It is an object of the present invention to provide a new and improved walking cane including a self-contained power source for illuminating a handle directed light beam and for illuminating an elongated tubular light source in a leg of the cane.

It is an object of the present invention to provide a new and improved walking cane utilizing a gas filled elongated tube as a light source extending along the length of a leg of the cane.

It is an object of the present invention to provide a new and improved walking cane providing at least one easily accessible switch for controlling a self-contained light mounted in the cane.

It is an object of the present invention to provide a new and improved walking cane employing replaceable batteries for supplying electrical power for at least one light in the cane.

It is an object of the present invention to provide a new and improved walking cane employing multiple switches for selectively controlling a plurality of lights in the cane.

BRIEF SUMMARY OF THE INVENTION

The foregoing and other objects and advantages of the present invention are accomplished in a new and improved walking cane having a leg with a foot at the lower end and a handle at the upper end with a hand gripping surface thereon. A flashlight is provided in the handle having a battery powered, switch controlled, forwardly directed, light for directing a light beam or light shaft forwardly of the cane to illuminate a walking path or area ahead of a user carrying the cane. The cane also includes an elongated tubular light in the leg which is battery powered and switch controlled for general illumination of a region or area around the cane.

BRIEF DESCRIPTION OF THE DRAWING

For a better understanding of the present invention reference should be made to the following detailed description taken in condition with the drawings, in which.

DETAILED DESCRIPTION OF THE INVENTION

Figure 2:
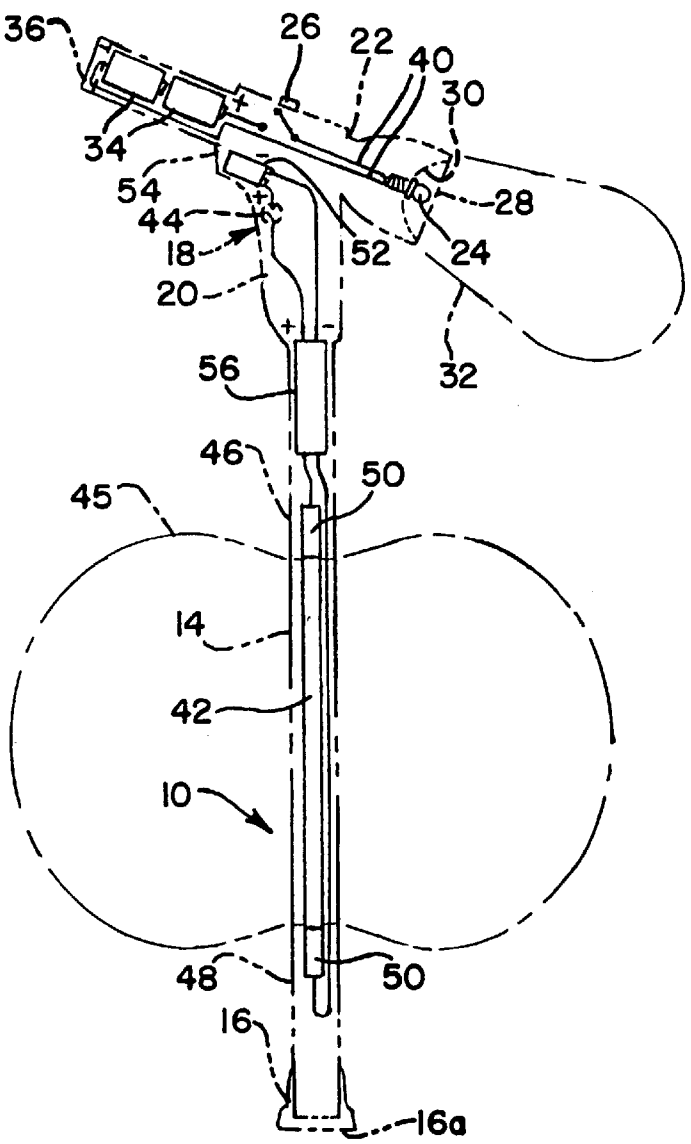
FIG. 2 is a schematic electrical diagram of the walking cane with the physical outline of the cane shown in a dotted line.
Figure 1:
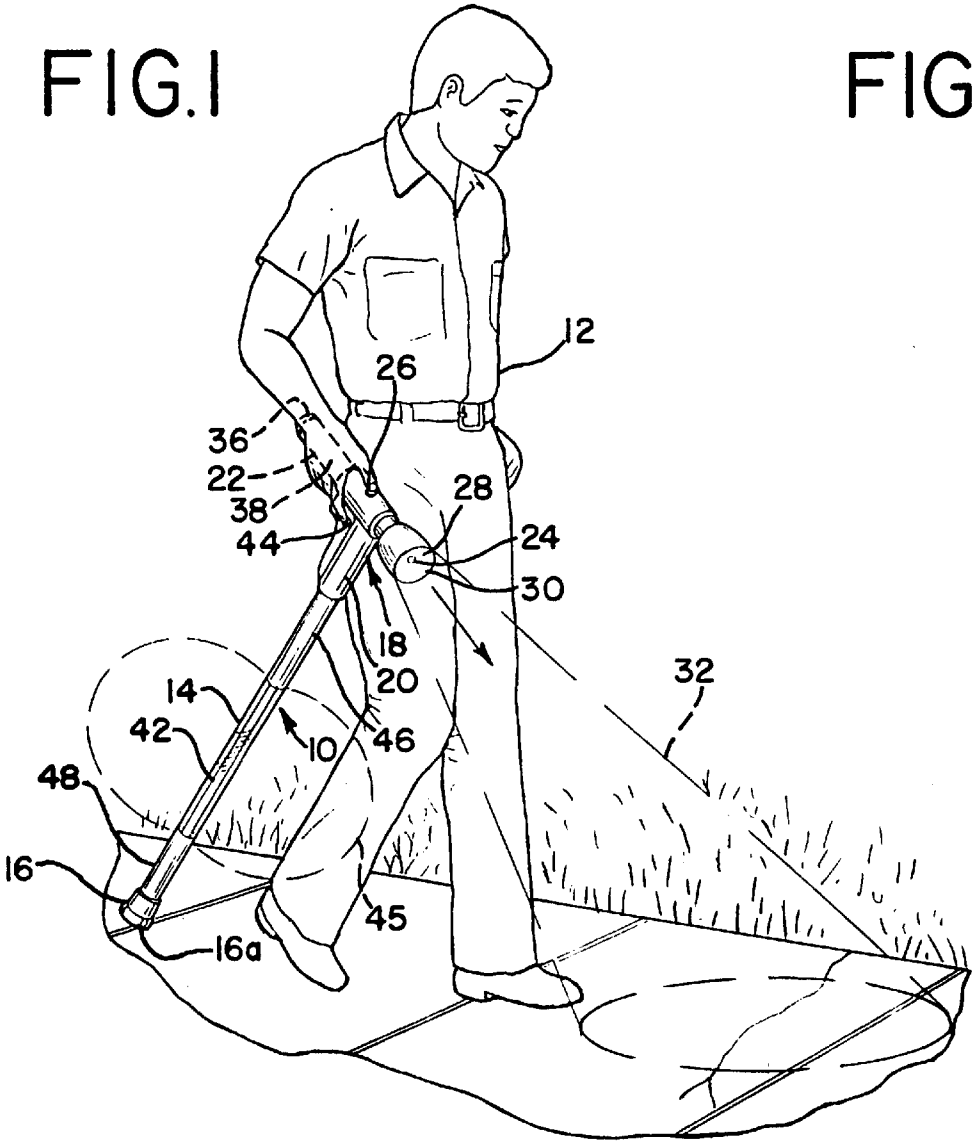
FIG. 1 is a side elevational view of a new and improved walking cane in accordance with the features of the present invention shown as the cane is used in the hand of a person walking or standing.

Referring now more particularly to the drawings, therein is illustrated a new and improved walking cane 10 constructed in accordance with the features of the present invention and especially adapted and designed for aiding a user 12 in walking and movement in and around areas of low light intensity both indoors and outdoors.

The walking cane 10 is easily manipulated to specifically illuminate a movement path or area immediately head of, to the side or forward of the user 12 and is also equipped to raise the illumination level generally around the area of the cane so that other lights don't have to be turned on which could wake or disturb other persons sleeping or present in the vicinity.

The walking cane 10 is particularly useful for a user 12 while walking outdoors at night or moving in unlighted or darkened areas such as theaters, bedrooms, hallways and the like.

In accordance with the invention, the walking cane 10 includes an elongated leg 14 formed of strong, tough, light weight, transparent or light transmitting plastic material such as acrylic resin or the like having a hollow tubular shape. At a lower end, the elongated leg 14 is provided with a foot 16 formed of rubber or other resilient material having an underside 16*a* of generally circular shape adapted to frictionally grip and engage a walking surface, floor surface, rug etc.

At an upper end portion, the walking cane 10 is provided with a handle or body 18 having a downwardly projecting portion 20 joined to an upper end portion of the leg 14 and a gripping and flashlight portion 22 extending angularly transversely thereto. The handle 18 is hollow and may be formed of stamped or molded metal, or molded plastic material that is tough, strong and relatively light in weight.

The transversely extending handle or body 18, has a flashlight bulb 24 at a forwardly facing end of the gripping portion 22, which bulb may be energized by activating a switch 26 on the upper surface of the body rearwardly of the bulb. The bulb 24 is protected by a transparent lens 28 and a frustro-conicol reflector 30 is provided to direct a forward beam of light 32 forwardly of the walking cane 10 for specifically illuminating an area directly ahead of the user when the bulb 24 is energized.

To the rear of the leg 14, the handle or body 18 is hollow to provide a cavity for holding a plurality of flashlight energizing batteries 34 and the rearward end of the cavity is normally closed by a removable threaded end cap 36. In order to facilitate gripping and support of the walking cane 10 in a users hand, an outer surface of the rearwardly extending gripping portion 22 of the handle or body 18 may be knurled or roughened. Conventional wiring 40 (FIG. 2) is provided for interconnecting the batteries 34, the control switch 26 and the light bulb 24.

In accordance with the present invention, the light beam 32 can be directed up and down and side ways as desired by manipulation of the gripping portion 22 of the body 18 in the hand of the user 12 for specifically illuminating a path of movement, a path of travel up or down stairs or steps and/or for locating objects or hazards to walking in areas of darkness or limited light.

The walking cane 10 also includes an elongated, hollow, gas filled tube light 42 mounted inside the hollow transparent section of the leg 14 between the foot 16 and the upper body or handle portion 18. The tube light 42 may produce white or colored light when energized by a control switch 44 on the handle or body 18 of the cane 10. Typically a "Neon" filled gas tube light 42 is provided to produce a "donut" shaped area 45 of general illumination around the cane leg 14 when energized. Because the tube light 42 is carried inside the hollow leg 14 it is well protected from damage and the light is positioned at a relatively low level so that persons sleeping on a bed in a darkened bedroom may not ever be awakened by illumination of the "Neon" light 42. Immediately above and below the "Neon" light 42, the cane leg 14 includes metal sections 46 and 48 joined to the hollow, transparent, clear plastic section and sockets 50 are mounted in these metal sections to support the "Neon" light in concentric relation with the central axis of the leg 14. One or more batteries 52 are provided in a space provided in the downwardly projecting portion 20 of the handle portion or body and a removable cap 54 is provided to enclose the batteries.

Referring to FIG. 2, a "Neon" power supply module 56 is mounted in the cane downwardly projecting portion 20 to provide electrical power of suitable voltage and amperage for energizing the tube light 42 when the control switch 44 is activated. A suitable power supply module 56 for the walking cane 10 is a "MIDGET 3000" requiring an input of 6–14 volts DC and providing an output of 3000 volts AC manufactured by "Tech 2000" of 5651 C Palmerway, Carlsbad, Calif.

From the foregoing description, it is clear that the new and improved walking cane 10 can be utilized effectively to illuminate a specific area with a flashlight beam of light 32 projected forwardly of the cane and/or to illuminate generally an area around a user 12 with a "donut" shaped illumination pattern 45 generating from the elongated "Neon" tube light 42 in the cane leg 14.

While the present invention has been described with reference to the details of the embodiment of the invention shown in the drawing, these details are not intended to limit the scope of the invention as claimed in the appended claims.

What is claimed is:

1. A walking cane comprising:

leg means having a foot for engaging a walking surface and handle means adapted to be grasped by the hand of a user;

said handle means including flashlight means for directing light forwardly of said cane while said handle means is grasped by a user, said leg means including tubular light generating means extending a substantial continuous length between said foot and said handle means for illuminating a region all around said leg means and along a substantial continuous length thereof.

2. The walking cane of claim 1, wherein:

said flashlight means includes a body having a gripping surface adapted to be grasped in a users' hand for movably directing a beam of light forwardly of said leg means.

3. The walking cane of claim 2, wherein:

said flashlight means includes light bulb means adjacent a forward portion of said body.

4. The walking cane of claim 3, wherein:

said body includes a cavity for holding battery means for energizing said light bulb means.

5. The walking cane of claim 2, wherein:

said flashlight means includes switch means on said body for controlling said light bulb means.

6. The walking cane of claim 4, wherein:

said cavity is positioned rearwardly of said leg means in said body.

7. The walking cane of claim 6, wherein:

said cavity is positioned inside said gripping surface.

8. The walking cane of claim 1, wherein:

said light generating means includes an elongated gas filled tube light.

9. The walking cane of claim 1, wherein:

said leg means includes structural wall means between said foot and said handle means formed of light transmitting material for passing light emitted from said light generating means.

10. The walking cane of claim 9, wherein:

said light generating means comprises an elongated gas filled tube and said structural wall means surrounds at least a portion of said tube.

11. The walking cane of claim 1, including:

switch means adjacent said handle means and electrically connected for controlling said light generating means.

12. The walking cane of claim 11, including:

power supply means for energizing said light generating means and electrically connected to be controlled by said switch means.

13. The walking cane of claim 1, wherein:

said flashlight means adjacent said handle means is positioned for directing a beam of light ahead of said leg means.

14. The walking cane of claim 13, wherein:

said flashlight means includes a beam forming light source adjacent a forward end of a body including light bulb means and a reflector, said body having a portion extending rearwardly of said leg means forming a gripping surface for said handle means.

15. The walking cane of claim 14, including:

electric power supply means in said cane electrically connected for energizing said flash light means and said light generating means.

16. The walking cane of claim 15, including:

control switch means electrically connected for selectively energizing said flash light means and said light generating means.

* * * * *